US012807452B2

(12) United States Patent
Apodaca Aguilar et al.

(10) Patent No.: US 12,807,452 B2
(45) Date of Patent: Nov. 24, 2026

(54) CORD WINDING SYSTEM

(71) Applicant: DISH Network L.L.C., Englewood, CO (US)

(72) Inventors: Juan Enrique Apodaca Aguilar, El Paso, TX (US); Sean Pichardo, El Paso, TX (US); Joel Cardoso Miranda, El Paso, TX (US); Humberto Alfonso Bolaños, Socorro, TX (US)

(73) Assignee: DISH Network L.L.C., Englewood, CO (US)

( * ) Notice: Subject to any disclaimer, the term of this patent is extended or adjusted under 35 U.S.C. 154(b) by 392 days.

(21) Appl. No.: 18/400,884

(22) Filed: Dec. 29, 2023

(65) Prior Publication Data

US 2025/0214804 A1 Jul. 3, 2025

(51) Int. Cl.
*B65H 54/74* (2006.01)
*B65H 61/00* (2006.01)

(52) U.S. Cl.
CPC ..... *B65H 54/74* (2013.01); *B65H 61/005* (2013.01); *B65H 2511/13* (2013.01); *B65H 2515/40* (2013.01); *B65H 2515/81* (2013.01); *B65H 2557/64* (2013.01); *B65H 2701/32* (2013.01); *B65H 2701/34* (2013.01)

(58) Field of Classification Search
CPC .. B65H 54/74; B65H 61/005; B65H 2511/13; B65H 2515/40; B65H 2515/81; B65H 2557/64; B65H 2701/32; B65H 2701/34; B65H 54/58; B65H 54/72; B65H 57/02
USPC ..... 242/532.6, 332, 332.1
See application file for complete search history.

(56) References Cited

U.S. PATENT DOCUMENTS 1,159,781 A * 11/1915 McCoy ..... B65H 39/16 242/532.6
5,308,236 A * 5/1994 Wing-Fai ..... A21C 9/02 242/532.6
7,793,880 B2 * 9/2010 Maruyama ..... H01F 41/077 242/538

(Continued)

FOREIGN PATENT DOCUMENTS

JP S6175774 A * 4/1986

OTHER PUBLICATIONS

JP61075774A English Translation, Takagi et al., Measuring, Cutting and Wind up Device for Flat Cable, Apr. 18, 1986 (Year: 1986).*

*Primary Examiner* — William A. Rivera
(74) *Attorney, Agent, or Firm* — Kilpatrick Townsend & Stockton LLP

(57) ABSTRACT

The present technology is generally directed to a cord winding system and a method of using thereof. In various embodiments, a cord winding system including: a motor; a winding assembly operably coupled to the motor, the winding assembly having an interior side and an exterior side, the winding assembly being configured to hold on the interior side respective first portions of a set of cords, and wind, driven by the motor, respective second portions of the set of cords around the exterior side, a second portion of a respective cord extending from the first portion thereof along a length of the cord, and a control unit programmed to actuate the motor for winding the set for a cycle time that relates to lengths of the cords.

20 Claims, 6 Drawing Sheets

(56) References Cited

U.S. PATENT DOCUMENTS

| | | | | |
|---|---|---|---|---|
| 2013/0152508 | A1* | 6/2013 | Solomon | B65H 54/58<br>53/430 |
| 2022/0216656 | A1* | 7/2022 | Pollard | B65H 54/44 |

* cited by examiner

CORD WINDING SYSTEM

TECHNICAL FIELD

The present technology is directed to cord winding systems and methods.

BACKGROUND

Various cords are used for connections between devices. Managing and handling these cords becomes a significant task, especially in environments such as warehouses of cable companies, internet service providers, etc.

SUMMARY

An aspect of the present disclosure relates to a cord winding system. The cord winding system may include: a motor; a winding assembly operably coupled to the motor, the winding assembly having an interior side and an exterior side, the winding assembly being configured to hold on the interior side respective first portions of a set of cords, and wind, driven by the motor, respective second portions of the set of cords around the exterior side, a second portion of a respective cord extending from the first portion thereof along a length of the cord, and a control unit programmed to actuate the motor for winding the set for a cycle time that relates to lengths of the cords.

Another aspect of the present disclosure relates to a method of using a cord winding system. The method may include selecting a winding configuration for winding a set of cords using a cord winding system, in which the cord winding system includes: a motor; and a winding assembly operably coupled to the motor, the winding assembly having an interior side and an exterior side; placing first portions of the cords in the interior side of the winding assembly; and causing the winding assembly to wind, according to a winding configuration that relates to lengths of the set of the cords and driven by the motor, respective second portions of the set of cords around the exterior side, a second portion of a respective cord extending from the first portion thereof along a length of the cord.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present disclosure.

DETAILED DESCRIPTION

Figure 1:
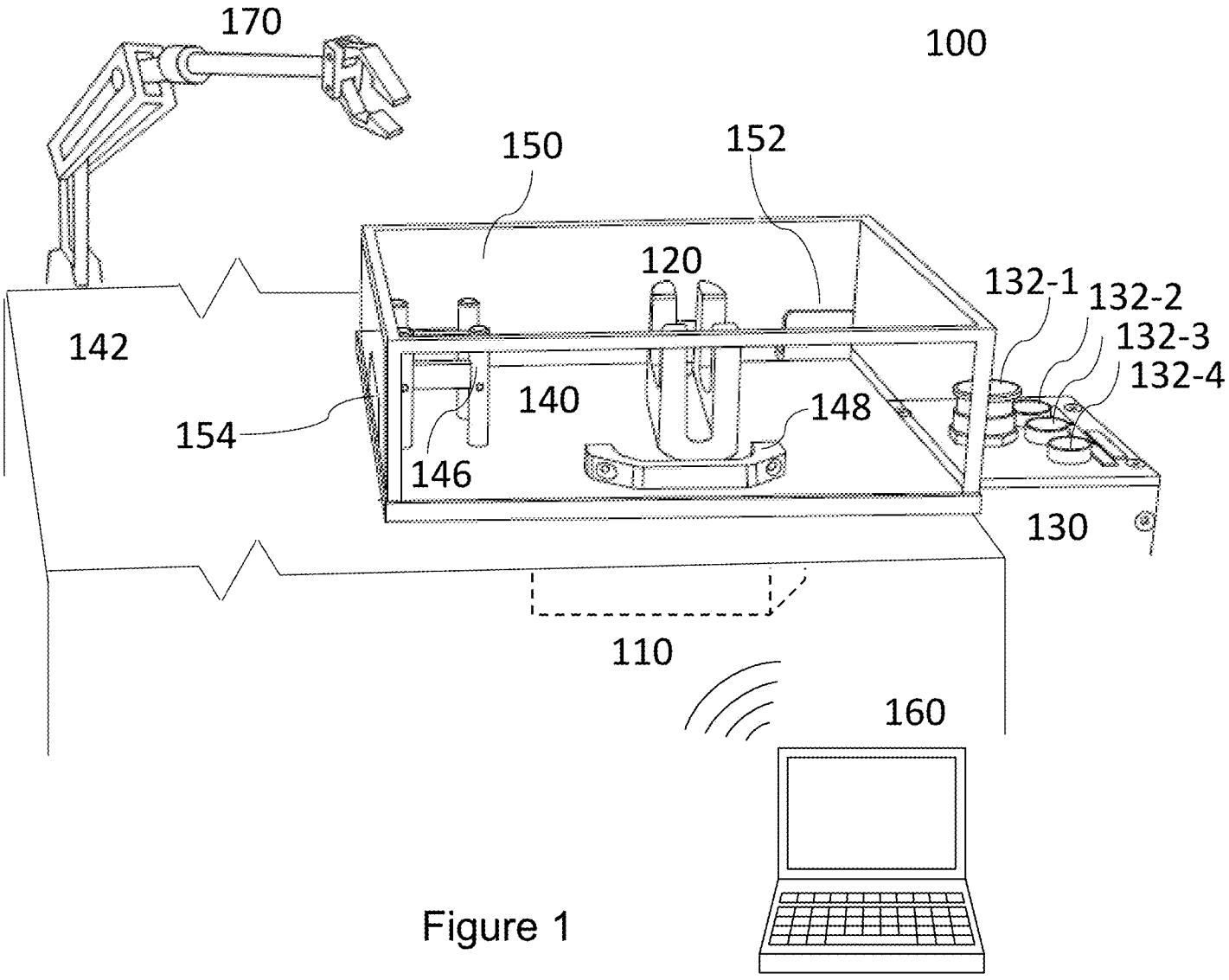
FIG. 1 is a perspective view of an illustrative cord winding system in accordance with some embodiments of the present disclosure.

Aspects of the present disclosure relate to a cord winding system and method of using thereof. In some embodiments, the cord winding system may include a motor, a winding assembly operably coupled to the motor, and a control unit, and be configured to wind a set of one or more cords. A respective cord may include a first portion and a second portion of extending from the first portion thereof along a length of the cord. The winding assembly may have an interior side and an exterior side. The winding assembly may be configured to hold on the interior side respective first portions of a set of cords, and wind, driven by the motor, respective second portions of the set of cords around the exterior side. The control unit may be programmed to actuate the motor for winding the set of cords for a cycle time that relates to lengths of the cords.

Environments such as, e.g., warehouses of cable companies, internet service providers, often deal with a variety of cables, such as coaxial cables, fiber optic cables, ethernet cables, power cords, universal serial bus (USB) cords, high-definition multimedia (HDMI) cords, and more. Cords serving different purposes may have different properties and need different handling and storage techniques. For example, cords of different types that serve different purposes may vary in one or more properties including, e.g., lengths, thicknesses, stiffness, or the like, or a combination thereof. Conversely, cords of a same type that serve the same purpose often have similar properties, as they are usually standardized and/or manufactured in batches. The cords often need to be sorted and/or bundled for storage, testing, etc.

The process of winding cords, especially those of substantially uniform or similar properties including, e.g., lengths, thicknesses, stiffness, etc., is repetitive and labor-intensive. This task can be significantly improved through automation using a cord winding system as disclosed herein. This system can efficiently handle the winding of cords in batches, making the process much more streamlined and less physically demanding.

When cords of substantially uniform or similar properties including, e.g., lengths, stiffness, etc., are wound in batches, it allows for a standardized approach to the winding process. The cycle time for each winding—the duration it takes to wind each cord or batch of cords—can be determined and optimized based on the lengths and/or other properties of the cords. This means that the cord winding system can be programmed to operate at a consistent pace, ensuring that each cord is wound properly and uniformly.

When the types of cords to be processed are known, suitable winding configurations of the cord winding system can be limited and therefore pre-programmed. This approach may eliminate the need for repetitive setup of the winding process for each type of cords.

Additionally or alternatively, the cord winding system as disclose may offer the flexibility of manual and/or automated winding configuration via the control unit that is programmable. This adaptability is advantageous in situations, e.g., where there are changes in cord properties, such as stiffness alterations due to temperature fluctuations, or when new types of cords are introduced for processing. Automated configuration can be efficiently achieved using sensor data, which allows the cord winding system to adjust its settings in response to real-time changes in cord characteristics or to accommodate different cord types. This flexibility may allow improved or optimal winding quality and efficiency under varying conditions and with diverse cord specifications.

The cord winding system may be configured to receive real-time feedback from one or more sensors during a winding operation and adjust the winding configurations accordingly. This feature may enhance the system's ability to adapt to various conditions and maintain the quality and/or efficiency of the winding process in response to a change in the winding operation due to, e.g., malfunction or failure of a component of the system, an external interfering factor (e.g., electrical noise, a fluctuation in power supply, excess vibration from nearby machinery or operation, etc.), a configuration error (e.g., a winding configuration determined based on an inaccurate parameter provided by a user or from a sensor), or the like, or a combination thereof.

Specific details of several embodiments of the present technology are described herein with reference to FIGS. 1-5. The present technology, however, can be practiced without some of these specific details. In some instances, well-known structures and techniques often associated cord winding systems, and the like, have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms can even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements can be arbitrarily enlarged to improve legibility. Component details can be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology.

Figure 2:
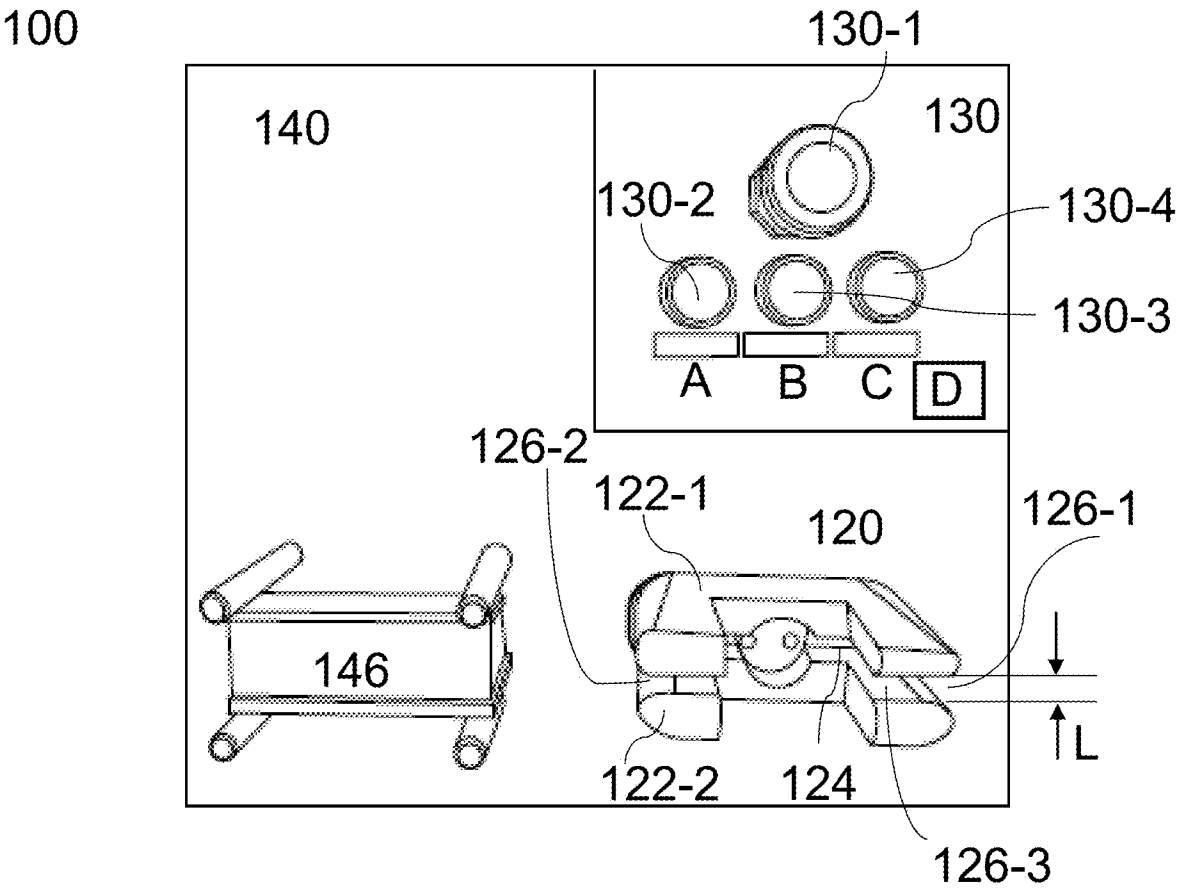
FIGS. 2 and 3 are top views of an illustrative system without and with cords in accordance with some embodiments of the present disclosure.
Figure 3:
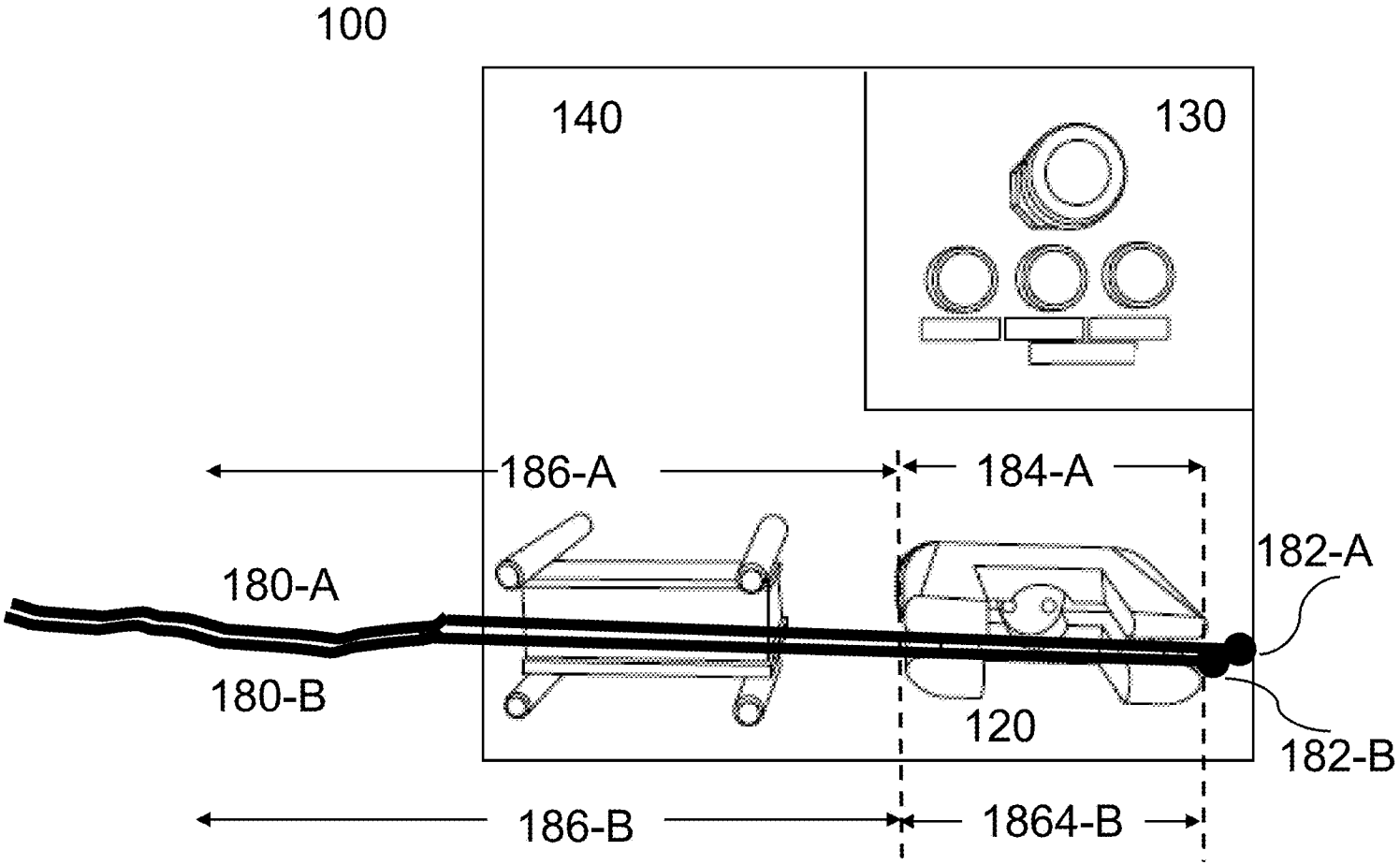

FIG. 1 is a perspective view of an illustrative cord winding system in accordance with some embodiments of the present document. FIG. 2 is a top view of an illustrative cord winding system in accordance with some embodiments of the present document. FIG. 3 illustrates an illustrative cord winding system 100 as illustrated in FIG. 2 with two cords placed in the system 100 for winding. The cord winding systems illustrated in FIGS. 1 and 2 are substantially the same except for the location of a control unit 130 relative to a support 140 where a winding assembly 120 is positioned. Specifically, the control unit 130 of the system illustrated in FIG. 1 is positioned outside the support 140, while the control unit 130 of the system illustrated in FIG. 2 is positioned on the support 140. For convenience, the two systems are referred to as system 100, and similar components are referred to using like reference numerals. Some components are shown in one of FIGS. 1 and 2 but not the other. For example, a processing device 160 and a robotic arm 170 are illustrated in FIG. 1 but not in FIG. 2. It is understood that such omission is not intended to be limiting. For example, the system 100 illustrated in FIG. 2 may include or be operably connected to a processing device 160 and/or a robotic arm 170 that are illustrated in only FIG. 1.

Figure 5:
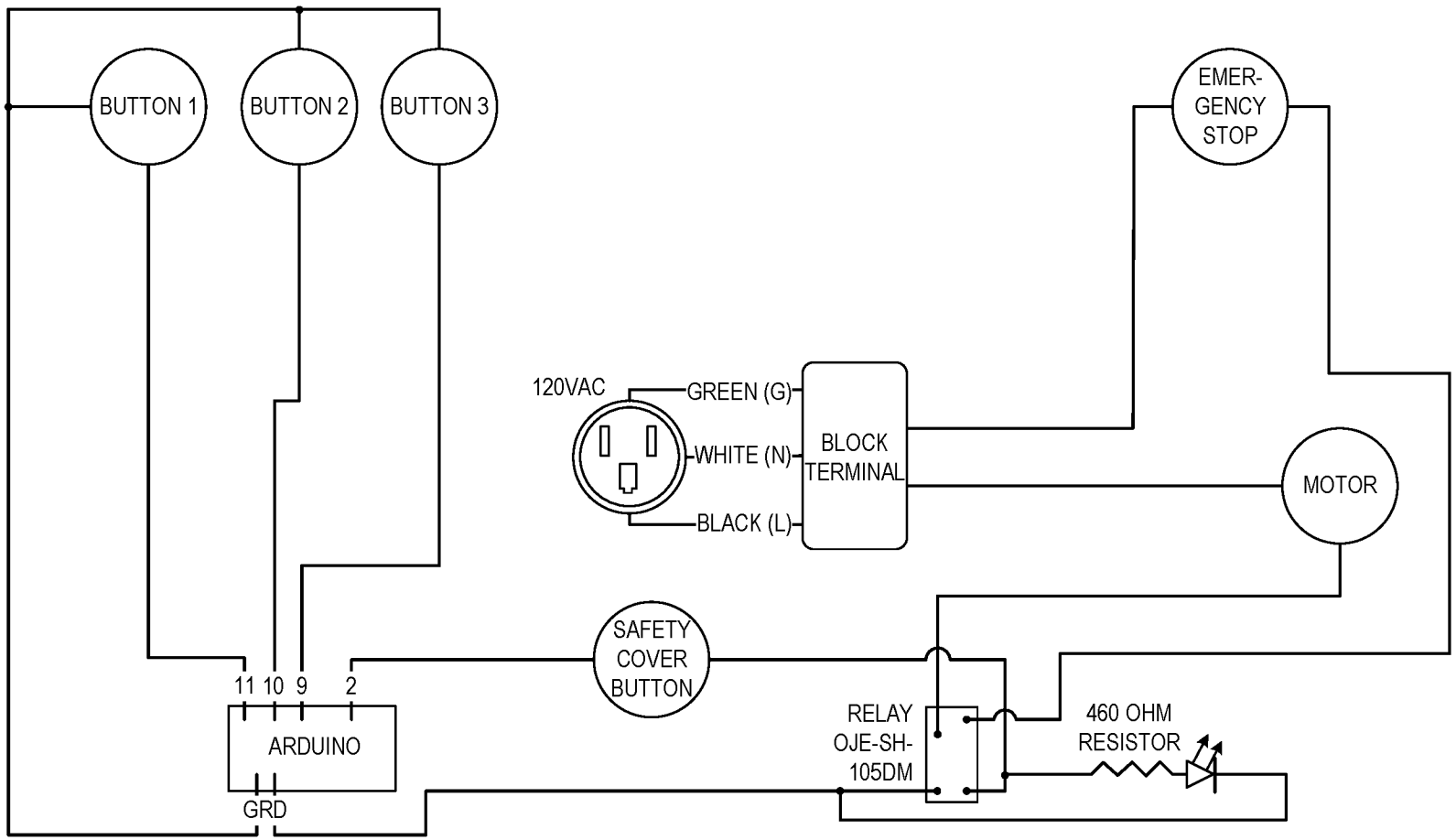
FIG. 5 is an electrical diagram of a control circuit in accordance with some embodiments of the present document.

The cord winding system 100 as illustrated may include a motor 110, a winding assembly 120 operably coupled to the motor 110, and a control unit 130. The motor 110 may be configured to drive the winding assembly 120 to rotate and wind a set of one or more cords. The winding assembly 120 may be configured to receive and wind a set of one or more cords as described in more detail below. In some embodiments, the winding assembly 120 may be driven by the motor 110 to wind the set of cords. The control unit 130 may include a microcontroller, e.g., an ARDUINO as illustrated in FIG. 5. The control unit 130 may include or be operably connected with a control panel including a plurality of control elements, e.g., an emergency stop button 132-1 and control buttons 132-2, 132-3, and 132-4 that correspond to respective winding configurations. As illustrated, the winding assembly 120 is rotatably supported on a support 140, which in turn may be supported on a work station 142. The cord winding system 100 may include a cord guide 146 configured to guide a set of one or more cords, or a portion of the respective cords, to be wound by the winding assembly 120. The cord winding system 100 may include a winding guide 148 positioned in a vicinity of the winding assembly 120 to guide the winding of cords. The cord winding system 100 may include a protective housing 150 configured to create an enclosure in which the winding assembly 120 is positioned.

The cord winding system 100 may include or be operably connected to a processing device 160. The processing device 160 may directly or indirectly, via the control unit 130, to control the operation of one or more other components of the cord winding system 100. The processing device 160 may provide an interface between the cord winding system 100 and a user. At least a portion of the operations during or otherwise relating to the winding operation (e.g., setting up cords on the winding assembly 120 for a winding operation) may be performed by a robotic arm 170. The robotic arm 170 may be controlled by or otherwise operably connected to the processing device 160. In some embodiments, the control unit 130 and the processing device 160 may be one integral equipment. In some embodiments, the control unit 130 and the processing device 160 may be configured as two separate devices.

The motor 110 may be a direct current (DC) motor, an alternate current (AC) motor, a stepper motor, or a servo motor. Merely by way of example, the motor 110 may operate on 115V AC. The torque of the motor 110 may be on the order of 1 or 10 pound-inches. For example, the torque of the motor 110 may be 2, 4, 6, 8, 10, 12, 15, 18, or 20 pound-inches. The rotation speed of the motor 110 may be in the range of 10 to 200 revolutions per minute, or in the range of 20 to 150 revolutions per minute, or in the range of 30 to 150 revolutions per minute, or in the range of 60 to 120 revolutions per minute, or approximately 60 revolutions per minute, or approximately 75 revolutions per minute, or approximately 90 revolutions per minute.

The winding assembly 120 may include two side walls 122 (individually identified as a first side wall 122-1 and a second side wall 122-2). The side walls 122 may be substantially parallel and/or oppose each other to form a groove 124. The groove 124 forms the interior side of the winding assembly 120, while the surfaces of the side walls 122, which face the surroundings, constitute the exterior side of the winding assembly 120. The winding assembly 120 may be configured to hold on the interior side respective first portions of a set of cords, and wind, driven by the motor 110, respective second portions of the set of cords around the exterior side. The set of cords may include one or more cords. Respective cords each may extend along their respective lengths. For any given cord, its second portion extends from the first portion along the cord's length. The groove 124 has a groove length along which the cords are placed within the groove 124. The groove 124 may have two ends 126 (individually identified as a first end 126-1 and a second end 126-2) that are spaced along the groove length and open to the surroundings of the winding assembly 120. The side walls 122 may be configured to rotate simultaneously. In some embodiments, the side walls 122 may be an integral piece. For example, the two side walls 122 may be connected by a bottom wall (see, e.g., item 2 in FIG. 4), and the three-wall structure may be made by, e.g., 3D printing. In some embodiments, the side walls 122 may be connected using a bottom wall using, e.g., glue, or other connection mechanism. The groove 124 may also have an opening 126-3 at the top ends of the side walls 122.

The side walls 122 may be spaced by a distance L sized to hold first portions of the set of cords during winding of respective second portions of a set of cords. The first portions of the cords of the set may have connectors at their respective end sections or configured otherwise so that dimensions of the end sections of the first portions are larger than the distance L. Accordingly, the first portions of the set may remain in the groove 124 during winding of the second portions because the end sections of the first portions of the cords cannot enter the groove 124. In some embodiments, the end sections of the first portions may be temporarily held in place by, e.g., a temporary holding mechanism (during winding of the second portions of the cords). Examples of such temporary holding mechanisms include a cord clip or clamp, a cord tie or zip tie, a Velcro strap, a grommet, an anchor point, a magnetic holder, etc. Such end sections may have a dimension larger or smaller than, or equal to, the space L. Merely by way of example, the end section of one cord is smaller than the distance L and accordingly the cord may slip into the groove 124 during winding of the second portion of the cord; however, when end sections of first portions of multiple cords are temporarily tied together (using, e.g., a zip tie, a Velcro strap, etc.), the dimension of the end sections of the bundle may be larger than the distance L so that the first portions of the cord may remain in the groove 124 during winding of the second portions of the cords.

As illustrated in FIG. 3, two cords 180 (individually identified as 180-A and 180-B) are placed in position to be wound in the cord winding system 100. A cord 180 has an end section 182 (individually identified as 182-A and 182-B), a first portion 184 (individually identified as 184-A and 184-B), and a second portion 186 (individually identified as 186-A and 186-B) extending along a length of the cord 180. The end sections are placed outside the first end 126-1. As illustrated, the respective end sections 182 have a larger dimension than the first portions 184. The individual end sections have a dimension smaller than the distance L of the groove 124, and the combined dimension of the end sections 182 of both cords 180 is larger than the distance L. The first portions 184 are placed within the groove 124 on the interior side of the winding assembly 120. The second portions 186 extend further along the lengths of the cords 180, and may pass through the cord guide 146 before being pulled to and wound on the exterior side of the winding assembly 120. While the second portions 186 are pulled and wound, the first portions 182 may remain within the groove 124.

To be wound using the winding assembly 120, portions (e.g., portions including or next to ends) of respective cords may be secured on the winding assembly 120 and next portions along the lengths of the respective cords may be placed within the cord guide 146. For example, the first portions of the cords may be placed into the groove 124 from the opening 126-3. The second portions of the cords may be pulled and wound on the exterior side of the winding assembly 120 when it rotates driven by the motor 110. In some embodiments, the set of cords may include multiple cords whose lengths are substantially the same, and the winding assembly 120 may be configured to wind the set substantially simultaneously. In some embodiments, the second portions of the cords may pass through the cord guide 146. When a set of multiple cords are wound at the same time, second portions of respective cords pass through the cord guide 146 so that they reach the winding assembly 120 in an orderly manner. The operation may be performed manually by a user, or automatically using, e.g., the robotic arm 170.

The winding assembly 120 may be operably coupled to the motor 110. Examples of the rotatable coupling between the winding assembly 120 and the motor 110 may include gear coupling, direct drive, worm and wheel gear, etc. Gear coupling may be established by a gear attached to the motor shaft and another gear attached to the winding assembly 120 (e.g., a bottom wall (e.g., item 2 in FIG. 4) of the winding assembly 120 that connect the two side walls 122); these gears interlock, so when the motor 110 turns its gear, it drives the gear on the winding assembly 120, causing the winding assembly 120 to rotate. Direct drive may be established by directly connecting the motor shaft of the motor 110 to the winding assembly 120 (e.g., a bottom wall (e.g., item 2 in FIG. 4) of the winding assembly 120 that connect the two side walls 122). Merely by way of example, this can be achieved through a coupling that aligns and secures the motor shaft to a center of the bottom wall of the winding assembly 120, allowing the motor 110 to rotate the bottom wall directly. Worm and wheel gear may be established by engaging a worm gear (resembling a screw) on the motor shaft with a wheel gear on the winding assembly 120 (e.g., a bottom wall (e.g., item 2 in FIG. 4) of the winding assembly 120 that connect the two side walls 122). The rotation of the worm gear causes the wheel gear, and thus the winding assembly 120, to rotate. The rotatable coupling between the mot4o 110 and the winding assembly 120 may be via a motor shaft adapter (e.g., item 3 in FIG. 4).

The winding guide 148 may be positioned in a vicinity of the winding assembly 120 to guide the winding of cords. For example, the winding guide 148 may help prevent the cords from winding exclusively in one direction, such as primarily on the surface 142. Without the winding guide 148, cords may tend to lay flat, covering a large surface area, leading to an unstable wound configuration. Such a configuration may lose its shape or unravel when the cords are removed from the winding assembly 120. With the assistance of the winding guide 148, however, the cords being wound may be encouraged to expand both horizontally, in alignment with the plane of support 140, and vertically. This may result in a more compact and uniformly rounded cord bundle, enhancing stability and maintaining the integrity of the wound cords. The winding guidance 148 may facilitate the winding process to produce a neatly organized and secure bundle, suitable for efficient handling and storage.

The protective housing 150 may be removably positioned on the support 140 or the support 140. For example, the protective housing 150 may be mounted on the support 140 using a hinge 152, allowing it to be easily opened or closed. The protective housing 150 may include multiple walls to create an enclosure where the winding assembly 120 is positioned. The protective housing 150 may include an opening 154 on at least one wall through which cords to be wound using the winding assembly 120 may enter the enclosure.

This protective housing 150 may be designed to enhance the functionality and/or safety of the cord winding system 100. The protective housing 150 may be built with a durable material such as, e.g., fiberglass, polycarbonate, acrylic, or the like, or a combination thereof. The protective housing 150 may feature transparent sections or inspection windows, allowing operators to monitor the winding process without opening the protective housing 150. As another example, a camera may be used to obtain operation condition within the protective housing 150, and transmit the obtained image data to a processing device, e.g., the processing device 160 where the image data may be processed to assess the operation condition and/or generate a notification to notify a user or the control unit 130 so that appropriate action (e.g., an emergency stop, maintaining an operation if the processing device 160 determines that no abnormality is observed) may be taken. The protective housing 150 may be configured to withstand the rigors of regular use and protect the winding assembly 120 from external elements like dust, moisture, and mechanical impact. The protective housing 150 can also be designed to dampen the noise produced by the winding assembly 120, contributing to a more comfortable working environment.

In some embodiments, the control unit 130 and the processing device 160 may be one integral equipment. In some embodiments, the control unit 130 and the processing device 160 may be configured as two separate devices that are configured to handle various aspects of the control of a winding operation. The processing device 160 may be configured to manage the winding assembly 120 and/or the motor 110 directly or via the control unit 130. Merely by way of example, the control unit 130 may be configured to directly control the operation of the winding assembly 120 based on pre-determined winding configuration(s) (e.g., the control unit 130 may receive a user selection of one of the pre-determined winding configurations and implement it), while the processing device 160 may interface with users and/or sensors to determine a winding configuration to be implemented, or make an adjustment thereof, and then transmit the determined or adjusted winding configuration to the control unit 130 for implementation. For ease of description, the control unit 130 and the processing device 160 are described together.

The control unit 130 (and/or the processing device 160) may receive information (e.g., user input, information relating to one or more cords, sensor data), processing such information, and/or provide information to one or more other components of the cord winding system 100 (e.g., a winding configuration to the control unit 130).

The control unit 130 (and/or the processing device 160) may be configured to actuate the motor 110 for winding the set of cords according to a winding configuration. The winding configuration may include at least one of a cycle time (or referred to as a winding time), a winding speed, a motor speed, or the like, or a combination thereof. The winding configuration may relate to one or more parameters including, e.g., the length of a cord, a cord type, the stiffness of a cord, the thickness of a cord, the ambient room temperature, or the like, or a combination thereof. Example cord types may include a coaxial cord, a fiber optic cord, an ethernet cord, a power cord, a USB cord, an HDMI cord, etc.

In some embodiments, the control unit 130 (and/or the processing device 160) may receive such parameter(s) as user input. For example, a user may enter, via a user interface (as described elsewhere in the present document), a cord length, a cord type, a room temperature, etc. In some embodiments, the control unit 130 (and/or the processing device 160) may receive such parameter(s) from one or more sensors. The core winding system 100 may include or communicate with multiple sensors to achieve efficient, safe, and effective functioning. Example sensors include a speed sensor configured to measure the winding speed of the winding assembly 120, a proximity sensor configured to detect the presence or absence of an object in the proximity of the winding assembly 120, a motor torque sensor configured to measure the torque output of the motor(s) of the winding assembly 120, a temperature sensor configured to monitor the ambient temperature or the temperature of one or more components like motors and bearings of the cord winding system 100, a vibration sensor configured to detect unusual vibrations in the cord winding system 100, an optical sensor (e.g., a photoelectric sensor) configured for various purposes (e.g., counting cords, detecting their position in the cord winding system 100), an emergency stop sensor (e.g., a button-based sensor) configured to allow for the immediate shutdown of the cord winding system 100 in case of an emergency, a radio-frequency identification (RFID) sensor configured to track the cords being processed using the winding assembly 120 (e.g., providing data for inventory management and process control), an ultrasound sensor configured for non-contact detection of cords or other components or objects in or near the cord winding system 100, a Hall effect sensor configured to detect the position of the winding assembly 120 and its components (e.g., for ensuring accurate synchronization of mechanical movements), etc.

The control unit 130 (and/or the processing device 160) may be configured to set a cycle time for a winding operation based on at least one of these parameters. For example, the control unit 130 (and/or the processing device 160) may be configured to determine a winding speed of the winding assembly based on at least one of ambient room temperature, a thickness of a respective cord, or stiffness of a respective cord; and determine the cycle time based on the winding speed and the length of a respective cord.

When cords of substantially uniform or similar properties including, e.g., lengths, stiffness, etc., are wound in batches, it allows for a standardized approach to the winding process. The cycle time for each winding—the duration it takes to wind each cord or batch of cords—can be determined and optimized based on the lengths and/or other properties of the cords. This means that the cord winding system can be programmed to operate at a consistent pace, ensuring that each cord is wound properly and uniformly.

When the types of cords to be processed are known, suitable winding configurations of the cord winding system can be limited and therefore pre-programmed. This approach may eliminate the need for repetitive setup of the winding process for each type of cords. For example, the control unit 130 (and/or the processing device 160) may have or be operably connection with a control panel that has a plurality of control elements 132. Merely by way of example, for known cord types, the control unit 130 (and/or the processing device 160) may be programmed with candidate winding configurations each of which correspond to a cord length. As illustrated in FIGS. 1 and 2, the control elements 132-3 and 132-4 correspond to different cord lengths of 6 feet and 8 feet, respectively. Such correspondence may be indicated using a table positioned near the control elements (e.g., buttons) 132-2 and 132-3. For example, there are tags B and C indicating 6 feet and 8 feet located directly underneath the control elements 132-3 and 132-4, respectively. The control element 132-2 may be used as a master control button or a safety interlock button. As illustrated, there is a tag A reading "WALLY" that is located directly underneath the control element 132-2. The master control button 132-2 may be designed for at least safety considerations. By requiring a user to press this button along with one of the cycle time buttons 132-3 and 132-4, it adds a layer of safety, ensuring that the machine only operates when intentionally commanded and under safe conditions. This setup may help to prevent accidental actuation and ensures that the machine operates only under the desired cycle time settings. For instance, to operate the cord winding system 100 for winding cords of approximately 6 feet, the user must simultaneously press both the specific control element 132-3 and the master control button 132-2. This dual-button mechanism may ensure precise and safe operation. If the user presses only one of the buttons—either control element 132-3 or master control button 132-2—the system 100 does not initiate the winding process. The control panel may also include an additional instructional tag D to prompt a user to select a cycle time by pressing a corresponding control element 132-3 or 132-4. Upon receiving a user selection, the control unit 130 (and/or the processing device 160) may operate the cord winding system 100 accordingly to wind a set of one or more cords by turning the motor for the corresponding cycle time.

The control unit 130 (and/or the processing device 160) may further incorporate one or more safety mechanisms including, e.g., emergency stop button (e.g., the control element 132-1 on the control panel of the control unit 130), overload alerts, and automatic shutdown protocols in case of malfunctions or excessive torque on the core winding system 100.

The control unit 130 (and/or the processing device 160) may be configured to control the operation of the cord winding system 100 (e.g., the winding assembly 120). Additionally or alternatively, the control unit 130 (and/or the processing device 160) may include on/off switches, a speed controller, a tension controller, or the like, or a combination thereof. By adjusting the speed and torque of the winding assembly 120 or the motor 110, it can ensure that the cord winding system 100 operates at optimal efficiency for different loads and conditions.

To achieve an effective cord winding operation, the processing device 160 may communicate with a series of sensors configured to provide feedback to the control unit 130 (and/or the processing device 160) to maintain consistent winding quality regardless of variations in cord properties. These sensors can detect various parameters such as the winding speed of the winding assembly 120, the current ambient temperate, the temperature of components of the cord winding system 100 (e.g., the motor, the temperature within the enclosure of the protective housing 150), the torque applied or sustained on the winding assembly 120 and/or the motor 110, or the like, or a combination thereof. This data may be fed back to the processing device 160, which uses it to make real-time assessment and/or adjustments to a winding configuration, the operation of the motor 110, etc. The processing device 160 may also perform failure or defect detection to detect issues with various components of the core winding system 100, e.g., the status of the motor 110, the condition of the winding assembly 120, the temperature of the motor 110, or the like, or a combination thereof. This feature may enhance the system's ability to adapt to various conditions and maintain the quality and/or efficiency of the winding process in response to a change in the winding operation due to, e.g., malfunction or failure of a component of the system, an external interfering factor (e.g., electrical noise, a fluctuation in power supply, excess vibration from nearby machinery or operation, etc.), a configuration error (e.g., a winding configuration determined based on an inaccurate parameter provided by a user or from a sensor), or the like, or a combination thereof.

The control unit 130 (and/or the processing device 160) may include memory and one or more processors. Memory can store instructions for running one or more applications or modules on the one or more processors. For example, the memory may be used in one or more embodiments to house all or some of the instructions needed to implement the functionality of sensor data retrieval, communications with other components of the cord winding system 100 (e.g., the motor 110, the control unit 130 (and/or the processing device 160), sensors configured to monitor operation related information, control command generation, etc.; processor(s) may be used to execute the instructions to implement the implement the functionality of sensor data retrieval, communications, control command generation, etc.

In some embodiments, the memory of the control unit 130 (and/or the processing device 160) can include any device, mechanism, or populated data structure used for storing information. In accordance with some embodiments of the present disclosures, memory can encompass, but is not limited to, any type of volatile memory, nonvolatile memory, and dynamic memory. For example, the memory can be random access memory, memory storage devices, optical memory devices, magnetic media, floppy disks, magnetic tapes, hard drives, SIMMs, SDRAM, RDRAM, DDR, RAM, SODIMMs, EPROMs, EEPROMs, compact discs, DVDs, and/or the like. In accordance with some embodiments, memory may include one or more disk drives, flash drives, one or more databases, one or more tables, one or more files, local cache memories, processor cache memories, relational databases, flat databases, and/or the like. In addition, those of ordinary skill in the art will appreciate many additional devices and techniques for storing information that can be used as memory. In some example aspects, memory may store at least one database containing the customizable features of the networks, a prioritized order of the networks, or user requested content information, such as audio or video data.

The processor(s) of the control unit 130 (and/or the processing device 160) may include one or more programmable processors executing one or more computer programs to perform functions by operating on input data and generating output. The processor(s) may also be implemented as, special purpose logic circuitry, e.g., an FPGA (field programmable gate array) or an ASIC (application specific integrated circuit). The processor(s) may include both general and special purpose microprocessors, and any one or more processors of any kind of digital computer. Merely by way of example, the processing device 160 may include a programmable logic controller (PLC) or a similar programmable controller. This unit may process input data from the sensors and execute predefined control algorithms to adjust the winding operation. The PLC may allow for precise control over the cord winding system 100, ensuring that it responds appropriately to varying operation conditions including, e.g., load conditions.

The control unit 130 (and/or the processing device 160) may communicate with one or more components of the cord winding system 100 via a wired or a wireless communication path. Examples of such communication paths may include the Internet, a mobile phone network, a mobile voice or data network (e.g., a 5G or Long Term Evolution (LTE) network), a cable network, a public switched telephone network, a short-range wireless communication network (e.g., Bluetooth or Near Field Communications (NFC)), or other types of communications networks or combinations of communications networks. The communication paths may separately or together include one or more communications paths, such as a satellite path, a fiber-optic path, a cable path, a path that supports Internet communications (e.g., Internet Protocol television (IPTV)), free-space connections (e.g., for broadcast or other wireless signals), or any other suitable wired or wireless communications path or combination of such paths. The control unit 130 (and/or the processing device 160) may include additional communication paths linking a plurality of hardware, software, and/or firmware components operating together. For example, the control unit 130 (and/or the processing device 160) may be implemented by a cloud of computing platforms operating together as the control unit 130 (and/or the processing device 160).

The control unit 130 (and/or the processing device 160) may be further connected to or integrated with, via one or more such communication paths, a network of sensors, or broader warehouse or factory management software, allowing for automated operation based on the overall workflow. This integration can optimize the use of the cord winding system 100 as part of a larger logistical operation.

The cord winding system 100 may include a user interface (UI), e.g., with a control panel, where operators can control, monitor, and/or intervene an operation of the cord winding system 100, input operational parameters, and override automatic controls if needed. This interface may allow a manual control over the system and for troubleshooting. The UI may serve as the bridge between aa user and the technical processes of the cord winding system 100. The UI may include a graphical user interface (GUI).

For example, the UI may feature a dashboard that provides a comprehensive overview of the cord winding system 100's current status including, e.g., real-time data on motor speed, winding assembly 120, etc. The UI may have a dedicated section for controlling and adjusting the motor or winding speed. This may be implemented through a slider or input field where the user can set a specific speed or choose from pre-defined speed settings optimized for different load types. The UI may include an interface element for monitoring and adjusting the winding speed of the winding assembly 120. The UI may also display the recommended winding speed for various lengths or types of cords to be processed using the winding assembly 120. The UI may include a UI element configured to allow a user to manually adjust or set parameters for winding configurations of the winding assembly 120 including, e.g., manual override options for situations where a specific winding configuration is needed. The UI may present data from various sensors, such as speed sensors, temperature sensors, etc. This data may help the user understand the current operating conditions of the cord winding system 100 and make informed decisions. The UI may provide access to historical data and logs, detailing past operations, changes made, and any alerts or issues that have arisen. This may assist the user for troubleshooting and understanding the long-term performance of the cord winding system 100. The UI may feature an alert system, notifying users of any issues, such as malfunctions, excessive load, or deviations from optimal operating conditions. This ensures immediate attention to any potential problems. The UI may have an UI element for help and support, providing users with guidance on how to operate the cord winding system 100, troubleshoot issues, and understand the readings and controls. Users may be able to customize certain aspects of the UI, such as display settings, notification preferences, and control panel layouts, to suit their individual needs and preferences. The UI may include quick-access buttons for emergency stops and other safety protocols, ensuring that users can quickly respond to any hazardous situations. The cord winding system 100 may offer remote access capabilities, allowing users to monitor and control the cord winding system 100 from different locations. Additionally, the UI may integrate with other systems in the facility for coordinated operations.

Figure 4:
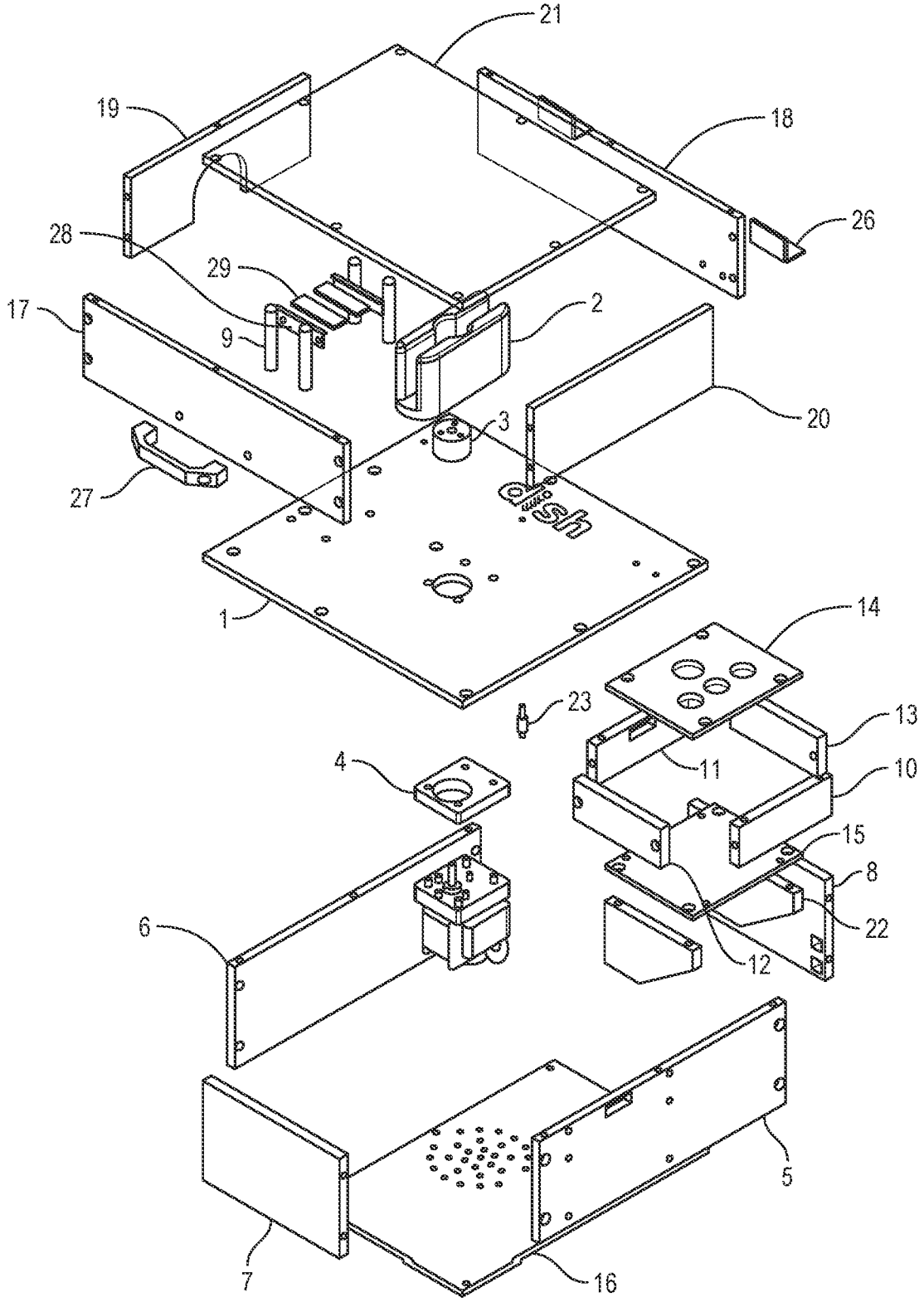
FIG. 4 is an exploded view of an illustrative cord winding system in accordance with some embodiments of the present disclosure.

FIG. 4 is an exploded view of an illustrative cord winding system in accordance with some embodiments of the present disclosure. Below is a table listing the illustrated items. Column 1 is the item numbers as illustrated in FIG. 4. Column 2 provides the correspondence between the items shown in FIG. 4 and those in FIGS. 1 and 2. In column 2, an item identified as "not shown/labeled" indicates that the item is not shown or labeled in FIG. 1 or FIG. 2. Columns 3 and 4 are description and the quality of the items illustrated in FIG. 4.

| ITEM NO. | Correspondence | Description | QTY. |
|---|---|---|---|
| 1 | 140 | COMP, MULTIPRODUCT CORD WINDER, BASE PLATE, MFG | 1 |
| 2 | 122-1 & 122-2 | COMP, MULTIPRODUCT CORD WINDER, OBLONG CORD, WINDER BLOCK, MFG | 1 |
| 3 | 110 | COMP, MULTIPRODUCT CORD WINDER, MOTOR SHAFT ADAPTER, MFG | 1 |
| 4 | | COMP, MULTIPRODUCT CORD WINDER, MOTOR MOUNT SPACER, MFG | 1 |
| 5 | Electrical | COMP, MULTIPRODUCT CORD WINDER, ELECTRICAL BOX RIGHT PANEL, MFG | 1 |
| 6 | box panels, | COMP, MULTIPRODUCT CORD WINDER, ELECTRICAL BOX LEFT PANEL, MFG | 1 |
| 7 | not shown | COMP, MULTIPRODUCT CORD WINDER, ELECTRICAL BOX FRONT PANEL, MFG | 1 |
| 8 | | COMP, MULTIPRODUCT CORD WINDER, ELECTRICAL BOX REAR PANEL, MFG | 1 |
| 9 | Cord guide pins of 146 | COMP, MULTIPRODUCT CORD WINDER, CORD GUIDE PINS, MFG | 4 |
| 10 | Button box | COMP, MULTIPRODUCT CORD WINDER, BUTTON BOX FRONT PANEL, MFG | 1 |
| 11 | panels of | COMP, MULTIPRODUCT CORD WINDER, BUTTON BOX REAR PANEL, MFG | 1 |
| 12 | control | COMP, MULTIPRODUCT CORD WINDER, BUTTON BOX LEFT PANEL, MFG | 1 |
| 13 | panel of 130 | COMP, MULTIPRODUCT CORD WINDER, BUTTON BOX RIGHT PANEL, MFG | 1 |
| 14 | | COMP, MULTIPRODUCT CORD WINDER, BUTTON BOX TOP PANEL, MFG | 1 |
| 15 | | COMP, MULTIPRODUCT CORD WINDER, BUTTON BOX BOTTOM PANEL, MFG | 1 |
| 16 | Not shown | COMP, MULTIPRODUCT CORD WINDER, ELECTRICAL BOX EXHAUST PANEL, MFG | 1 |
| 17 | 150 | COMP, MULTIPRODUCT CORD WINDER, TOP GUARD FRONT PANEL, MFG | 1 |
| 18 | | COMP, MULTIPRODUCT CORD WINDER, TOP GUARD REAR PANEL, MFG | 1 |
| 19 | | COMP, MULTIPRODUCT CORD WINDER, TOP GUARD LEFT PANEL, MFG | 1 |
| 20 | | COMP, MULTIPRODUCT CORD WINDER, TOP GUARD RIGHT PANEL, MFG | 1 |
| 21 | | COMP, MULTIPRODUCT CORD WINDER, TOP GUARD TOP PANEL, MFG | 1 |

-continued

| ITEM NO. | Correspondence | Description | QTY. |
|---|---|---|---|
| 22 | Not shown/ labeled | COMP, MULTIPRODUCT CORD WINDER, ELECTRICAL BOX SHELF BRACKET, MFG | 2 |
| 23 | Not shown/ labeled | ECOMP, PLUNGER PUSH BUTTON SWITCH, MFG | 1 |
| 24 | Not shown/ labeled | ECOMP, MULTIPRODUCT CABLE WINDER, AC GEAR MOTOR, 15 IN.-LBS TORQUE, 75 RPM, 115 V AC, FACE MOUNT, MFG | 1 |
| 26 | On 150 | HCOMP, MULTIPRODUCT CABLE WINDER, SURFACE MOUNT HINGE, 2" HIGH, 1" WIDE, NONREMOVABLE PIN, BLACK ZINC, MFG | 2 |
| 27 | On 150 | HCOMP, MULTIPRODUCT CABLE WINDER, PULL HANDLE, 3 15/16" CENTER TO CENTER, UNTHREADED HOLES, STATIC CONTROL, BLACK NYLON, MFG | 1 |
| 28 | Parts of 146 | HCOMP, MULTIPRODUCT CABLE WINDER, STRIP BRUSH HOLDER, 7/32" WIDE, 3/4" HIGH, ALUMINUM, RIGID, MFG | 2 |
| 29 | | HCOMP, MULTIPRODUCT CABLE WINDER, STRIP BRUSH, 1/8" WIDE, 3/32" HIGH BACKING, 2" OVERALL HEIGHT, BLACK NYLON, MFG | 2 |

FIG. 5 is an electrical diagram of a control circuit of the control unit 130 (or the processing device 160) in accordance with some embodiments of the present document. FIG. 5 illustrates "Button 1," "Button 2," and "Button 3," each corresponding to a cycle time corresponding to the length of a specific cord, similar to control elements 132-3 and 132-4. These buttons may be the control inputs that allow a user to select different winding configurations (based on, e.g., cord lengths) or set specific functions for the motor 110. The control circuit includes a microcontroller ARDUINO of the control unit 130. Three pins 9, 10, and 11 are connected to "Button 3," "Button 2," and "Button 1," respectively. Pin 2 of the microcontroller ARDUINO is connected to a Safety Cover Button, corresponding to control element 132-2, which is a master control button. Two pins of the microcontroller ARDUINO are grounded. The control circuit includes an emergency stop button, corresponding to control element 132-1. A relay labeled "OE-SH-105DM" is included, which is typically used to switch higher power circuits using a low power signal from the Arduino. A "460 ohm" resistor is shown in series with an LED or diode, for indicating the status of the relay or for protection purposes. The "Motor," corresponding to the motor 110, is the output device of the circuit, and the end effecter that does the work. It is controlled through the relay. The diagram shows a "120 VAC" power supply with connections indicated by color: Green for ground (G), White for neutral (N), and Black for line (L). This supply may power the motor and might be providing power to the relay as well. There is a "Block Terminal" where the power supply wires are connected, serving as a junction point for distributing power to the components that need it.

Below is an example Arduino code executed on the microcontroller in the control unit 130.

```
const int buttonpin = 9; // THE PUSH BUTTON PIN
const int buttonpin2 = 10; // THE PUSH BUTTON PIN
const int buttonpin3 = 11; // THE PUSH BUTTON PIN
const int motor = 2;      // THE MOTOR PIN
int buttonstate = 0; // variable for reading the pushbutton status
int buttonstate2 = 0; // variable for reading the pushbutton status
int buttonstate3 = 0; // variable for reading the pushbutton status
void setup( ) {
  pinMode(buttonpin, INPUT_PULLUP); //
  pinMode(buttonpin2, INPUT_PULLUP); //
  pinMode(buttonpin3, INPUT_PULLUP); //
  pinMode(motor, OUTPUT); //
  Serial.begin(9600); // open the serial port at 9600 bps:
}
void loop( ) {
  buttonstate = digitalRead(buttonpin);
  buttonstate2 = digitalRead(buttonpin2);
  buttonstate3 = digitalRead(buttonpin3);
  delay(100);
  if (buttonstate == LOW && buttonstate2 == HIGH && buttonstate3 == HIGH)
//Condition that will turn on motor for 2.6 seconds when pressing button 1 labeled
"Wally"
  {
    digitalWrite(motor, HIGH);
    Serial.print("BUTTON 1 PRESS");
    delay(2600);
  }
  if (buttonstate2 == LOW && buttonstate == HIGH && buttonstate3 == HIGH)
//Condition that will turn on motor for 2.7 seconds when pressing button 2 labeled "6
Ft"
  {
    digitalWrite(motor, HIGH);
    Serial.print("BUTTON 2 PRESS");
    delay(2700);
  }
```

-continued

```
  if (buttonstate3 == LOW && buttonstate == HIGH && buttonstate2 == HIGH)
//Condition that will turn on motor for 3.55 seconds when
pressing button 3 labeled "8 Ft"
  {
    digitalWrite(motor, HIGH);
    Serial.print("BUTTON 3 PRESS");
    delay(3550);
  }
  if (buttonstate == LOW && buttonstate2 == LOW && buttonstate3 == HIGH)
//Condition that will turn on motor for as long as buttons 2 and 3 are pressed,
releasing buttons will stop motor.
  {
    digitalWrite(motor, HIGH);
    delay(100);
  }
  else
  {
    digitalWrite(motor, LOW);
  }
}
```

Figure 6:
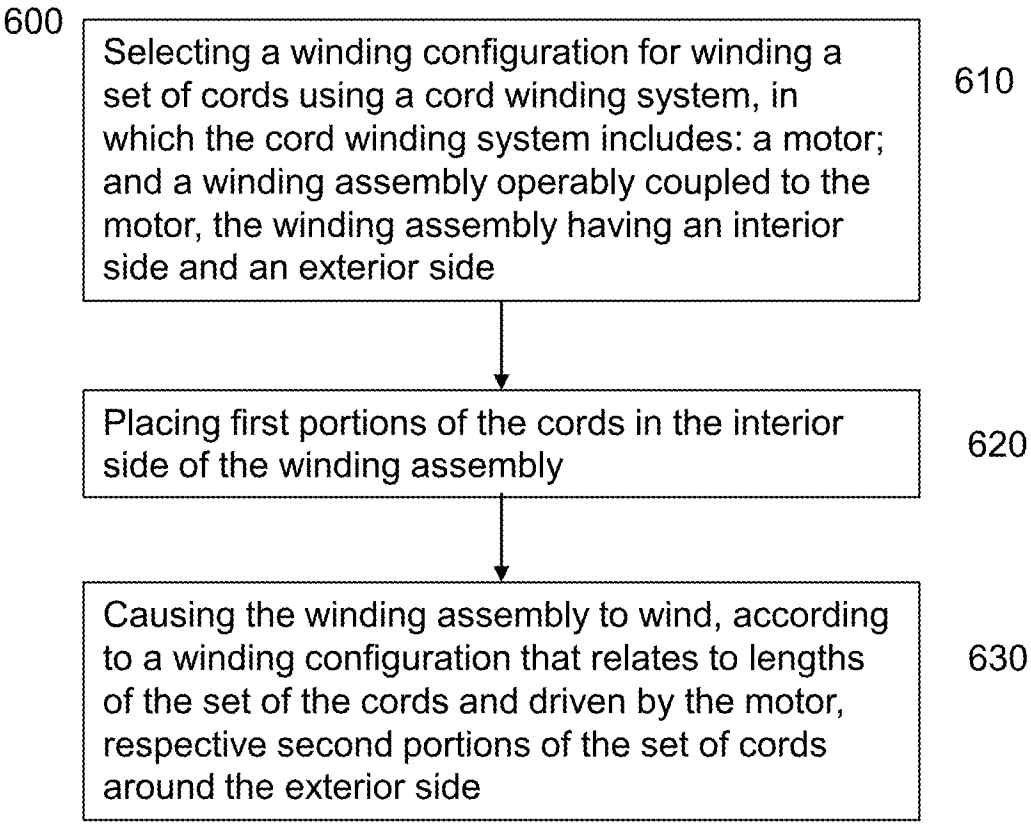
FIG. 6 is a flowchart for a method of using a cord winding system in accordance with some embodiments of the present disclosure.

FIG. 6 is a flowchart for a method of using a cord winding system in accordance with some embodiments of the present disclosure. The process 500 may include selecting at 610 a winding configuration for winding a set of cords using a cord winding system, in which the cord winding system includes: a motor; and a winding assembly operably coupled to the motor, the winding assembly having an interior side and an exterior side; placing at 620 first portions of the cords in the interior side of the winding assembly; and causing at 630 the winding assembly to wind, according to a winding configuration that relates to lengths of the set of the cords and driven by the motor, respective second portions of the set of cords around the exterior side. A respective cord may have a second portion extending from the first portion thereof along a length of the cord.

The first portions 18 of the cords may be placed in the interior side of the winding assembly (e.g., the winding assembly 120) from an opening (e.g., the opening 126-3). End sections of the first portions may have a larger dimension than a groove (e.g., groove 124) within the winding assembly where the first portions are placed, or otherwise secured, so that the first portions may remain within the groove while second portions of the cords may be pulled and wound around the exterior side of the winding assembly.

In some embodiments, the process 500 may include receiving, via a user interface, user input regarding the winding configuration. For example, the winding configuration includes a cycle time, and the process 500 may include receiving an instruction regarding a cycle time.

In some embodiments, the process 500 may include determining the winding configuration based on at least one parameter including a length of at least one cord of the set, ambient room temperature, a cord type, thickness of a respective cord, or stiffness of a respective cord. In some embodiments, the process 500 may include receiving the at least one parameter from one or more sensors. In some embodiments, the process 500 may include receiving, from a user via a user interface, the at least one parameter.

Merely by way of example, the winding configuration includes a winding speed and a cycle time. The process 500 may further include: determining the winding speed of the winding assembly based on at least one of ambient room temperature, a thickness of a respective cord, or stiffness of a respective cord; and determining the cycle time based on the winding speed and the length of a respective cord.

Some embodiments may implement one or more of the following solutions, listed in clause-format. The following clauses are supported and further described in the embodiments above and throughout this document.

1. A cord winding system, including: a motor; a winding assembly operably coupled to the motor, the winding assembly having an interior side and an exterior side, the winding assembly being configured to hold on the interior side respective first portions of a set of cords, and wind, driven by the motor, respective second portions of the set of cords around the exterior side, a second portion of a respective cord extending from the first portion thereof along a length of the cord, and a control unit programmed to actuate the motor for winding the set for a cycle time that relates to lengths of the cords.
2. The cord winding system of any one or more solutions disclosed herein, in which the winding assembly includes two side walls that oppose each other, the interior side of the winding assembly including a groove with two open ends formed between the side walls.
3. The cord winding system of any one or more solutions disclosed herein, in which the side walls are spaced by a distance sized to hold the first portions of the set during winding of the second portions.
4. The cord winding system of any one or more solutions disclosed herein, in which the first portions of the respective cords of the set have connectors whose dimensions are larger than the distance such that the first portions of the set remain in the groove during winding of the second portions.
5. The cord winding system of any one or more solutions disclosed herein, in which the set of cords include one or more cords.
6. The cord winding system of any one or more solutions disclosed herein, in which: the set of cords include multiple cords whose lengths are substantially the same, and the winding assembly is configured to wind the set substantially simultaneously.
7. The cord winding system of any one or more solutions disclosed herein, in which the control unit is configured to set the cycle time based on at least one parameter including a length of at least one cord of the set, ambient room temperature, a cord type, thickness of a respective cord, or stiffness of a respective cord.

8. The cord winding system of any one or more solutions disclosed herein, in which the control unit is configured to receive, via a user interface, user input regarding the at least one parameter.
9. The cord winding system of any one or more solutions disclosed herein, in which the control unit is configured to receive the at least one parameter from one or more sensors.
10. The cord winding system of any one or more solutions disclosed herein, further including: at least one of the one or more sensors is configured to provide feedback to the control unit to maintain consistent winding quality regardless of variations in cord properties.
11. The cord winding system of any one or more solutions disclosed herein, in which the control unit is configured to: determine a winding speed of the winding assembly based on at least one of ambient room temperature, a thickness of a respective cord, or stiffness of a respective cord; and determine the cycle time based on the winding speed and the length of a respective cord.
12. The cord winding system of any one or more solutions disclosed herein, in which the control unit includes memory storage for saving preset winding configurations.
13. The cord winding system of any one or more solutions disclosed herein, further including a control panel that has a plurality of control elements, each of the plurality of control elements corresponding to one of a preset winding configuration.
14. The cord winding system of any one or more solutions disclosed herein, in which the control panel further includes a safety control configured to turn the winding assembly on or off.
15. The cord winding system of any one or more solutions disclosed herein, in which the control unit is configured to receive a selection of one of the control elements and determine the cycle time based on the received selection.
16. The cord winding system of any one or more solutions disclosed herein, further including a support on which the winding assembly is mounted.
17. The cord winding system of any one or more solutions disclosed herein, further including a protective housing within which the winding assembly is placed.
18. The cord winding system of any one or more solutions disclosed herein, in which the protective housing has an opening through which the second portions of the cords passes, allowing the second portions to be wound onto the exterior side of the winding assembly.
19. A method, including: selecting a winding configuration for winding a set of cords using a cord winding system, in which the cord winding system includes: a motor; and a winding assembly operably coupled to the motor, the winding assembly having an interior side and an exterior side; placing first portions of the cords in the interior side of the winding assembly; and causing the winding assembly to wind, according to a winding configuration that relates to lengths of the set of the cords and driven by the motor, respective second portions of the set of cords around the exterior side, a second portion of a respective cord extending from the first portion thereof along a length of the cord.
20. The method of any one or more solutions disclosed herein, further including: receiving, via a user interface, user input regarding the winding configuration.
21. The method of any one or more solutions disclosed herein, in which the winding configuration includes a cycle time, the method further including: receiving an instruction regarding a cycle time.
22. The method of any one or more solutions disclosed herein, further including: determining the winding configuration based on at least one parameter including a length of at least one cord of the set, ambient room temperature, a cord type, thickness of a respective cord, or stiffness of a respective cord.
23. The method of any one or more solutions disclosed herein, further including: receiving the at least one parameter from one or more sensors.
24. The method of any one or more solutions disclosed herein, further including: receiving, from a user via a user interface, the at least one parameter.
25. The method of any one or more solutions disclosed herein, in which the winding configuration includes a winding speed and a cycle time, the method further including: determining the winding speed of the winding assembly based on at least one of ambient room temperature, a thickness of a respective cord, or stiffness of a respective cord; and determining the cycle time based on the winding speed and the length of a respective cord.
26. A method of using a cord winding system of one or more of solutions disclosed herein.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present technology have been shown and described, it will be obvious to those skilled in the art that, based upon the teachings herein, changes and modifications may be made without departing from this technology and its broader aspects and, therefore, the appended claims are to encompass within their scope all such changes and modifications as are within the true spirit and scope of this technology. Furthermore, it is to be understood that the technology is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to technologies containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For example, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Aspects of the present disclosure, for example, are described above with reference to block diagrams and/or operational illustrations of methods, systems, and computer program products according to aspects of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The description and illustration of one or more aspects provided in this application are not intended to limit or restrict the scope of the disclosure as claimed in any way. The aspects, examples, and details provided in this application are considered sufficient to convey possession and enable others to make and use the best mode of the claimed disclosure. The claimed disclosure should not be construed as being limited to any aspect, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and the alternate aspects falling within the spirit of the broader aspects of the general inventive concept embodied in this application that do not depart from the broader scope of the claimed disclosure.

From the foregoing, it will be appreciated that specific embodiments of the invention have been described herein for purposes of illustration, but that various modifications may be made without deviating from the scope of the invention. Accordingly, the invention is not limited except as by the appended claims.

What is claimed is:

1. A cord winding system, comprising:

a motor;

a winding assembly operably coupled to the motor, the winding assembly having an interior side and an exterior side, the winding assembly being configured to hold on the interior side respective first portions of a set of cords, and wind, driven by the motor, respective second portions of the set of cords around the exterior side, a second portion of a respective cord extending from the first portion thereof along a length of the cord, the winding assembly comprising two side walls that oppose each other, the interior side of the winding assembly including a groove with two open ends formed between the side walls, the side walls being spaced by a distance sized to hold the first portions of the set during winding of the second portions, wherein the first portions of the respective cords of the set have connectors whose dimensions are larger than the distance such that the first portions of the set remain in the groove during winding of the second portions, and a control unit programmed to actuate the motor for winding the set for a cycle time that relates to lengths of the cords.

2. The cord winding system of claim 1, wherein the set of cords comprise one or more cords.

3. The cord winding system of claim 1, wherein:

the set of cords comprise multiple cords whose lengths are substantially the same, and the winding assembly is configured to wind the set substantially simultaneously.

4. The cord winding system of claim 1, wherein the control unit is configured to set the cycle time based on at least one parameter including a length of at least one cord of the set, ambient room temperature, a cord type, thickness of a respective cord, or stiffness of a respective cord.

5. The cord winding system of claim 4, wherein the control unit is configured to receive, via a user interface, user input regarding the at least one parameter.

6. The cord winding system of claim 4, wherein the control unit is configured to receive the at least one parameter from one or more sensors.

7. The cord winding system of claim 6, further comprising:

at least one of the one or more sensors is configured to provide feedback to the control unit to maintain consistent winding quality regardless of variations in cord properties.

8. The cord winding system of claim 1, wherein the control unit is configured to:

determine a winding speed of the winding assembly based on at least one of ambient room temperature, a thickness of a respective cord, or stiffness of a respective cord; and determine the cycle time based on the winding speed and the length of a respective cord.

9. The cord winding system of claim 1, wherein the control unit includes memory storage for saving preset winding configurations.

10. The cord winding system of claim 1, further comprising a control panel that has a plurality of control elements, each of the plurality of control elements corresponding to one of a preset winding configuration.

11. The cord winding system of claim 10, wherein the control panel further includes a safety control configured to turn the winding assembly on or off.

12. The cord winding system of claim 10, wherein the control unit is configured to receive a selection of one of the control elements and determine the cycle time based on the received selection.

13. The cord winding system of claim 10, wherein:

the plurality of control elements includes a master control element and one or more cycle-time control elements each corresponding to a respective preset winding configuration, and the control unit is configured to actuate the motor to wind the set only in response to simultaneous activation of the master control element and one of the one or more cycle-time control elements.

14. The cord winding system of claim 1, further comprising a support on which the winding assembly is mounted.

15. The cord winding system of claim 1, further comprising a protective housing within which the winding assembly is placed.

16. The cord winding system of claim 15, wherein the protective housing has an opening through which the second portions of the cords passes, allowing the second portions to be wound onto the exterior side of the winding assembly.

17. The cord winding system of claim 1, comprising a winding guide positioned in a vicinity of the winding assembly and configured to guide the second portions of the set during winding such that the second portions expand both along a plane of the winding assembly and in a direction transverse to the plane to form a compact wound bundle.

18. A method, comprising:

selecting a winding configuration for winding a set of cords using a cord winding system, wherein the cord winding system comprises:

a motor; and a winding assembly operably coupled to the motor, the winding assembly having an interior side and an exterior side, the winding assembly comprising two side walls that oppose each other, the interior side of the winding assembly including a groove with two open ends formed between the side walls, the side walls being spaced by a distance;

placing first portions of the cords in the interior side of the winding assembly, wherein the first portions of the respective cords have connectors whose dimensions are larger than the distance, and placing the first portions comprises inserting the first portions into the groove such that the first portions remain in the groove during winding of the second portions; and causing the winding assembly to wind, according to a winding configuration that relates to lengths of the set of the cords and driven by the motor, respective second portions of the set of cords around the exterior side, a second portion of a respective cord extending from the first portion thereof along a length of the cord.

19. The method of claim 18, further comprising:

receiving, via a user interface, user input regarding the winding configuration.

20. The method of claim 18, wherein:

the winding assembly comprises two side walls that oppose each other and a groove with two open ends formed between the side walls, and the placing the first portions of the cords in the interior side of the winding assembly comprises inserting the first portions into the groove, the first portions having connectors whose dimensions are larger than a distance between the side walls such that the first portions remain in the groove during winding of the second portions.

* * * * *